US005729813A

United States Patent [19]

Eddy et al.

[11] Patent Number: 5,729,813

[45] Date of Patent: Mar. 17, 1998

[54] THIN, THERMALLY CONDUCTIVE FLUOROELASTOMER COATED FUSER MEMBER

[75] Inventors: Clifford O. Eddy, Webster; Louis D. Fratangelo, Fairport; George J. Heeks, Rochester; Arnold W. Henry, Pittsford; Alan R. Kuntz, Webster; Rabin Moser, Victor; David Battat, Rochester; Samuel Kaplan, Walworth; Santokh S. Badesha, Pittsford; Che Chung Chow, Penfield; David H. Pan, Rochester; David J. J. Fraser; Yu-Hsing Chin, both of Webster, all of N.Y.

[73] Assignee: Xerox Corporation, Stamford, Conn.

[21] Appl. No.: 572,212

[22] Filed: Dec. 13, 1995

Related U.S. Application Data

[63] Continuation-in-part of Ser. No. 411,199, Mar. 27, 1995, abandoned.

[51] Int. Cl.[6] ..... G03G 15/20

[52] U.S. Cl. ..... 399/333; 428/421; 492/56

[58] Field of Search ..... 355/282, 285, 355/289, 290; 219/216, 469; 399/333; 492/56, 59; 428/421, 906

[56] References Cited

U.S. PATENT DOCUMENTS

| | | | |
|---|---|---|---|
| Re. 33,172 | 2/1990 | Gruber et al. | 430/39 |
| 3,912,901 | 10/1975 | Strella et al. | 219/216 |
| 4,029,827 | 6/1977 | Imperial et al. | 427/22 |
| 4,257,699 | 3/1981 | Lentz . | |
| 4,264,181 | 4/1981 | Lentz et al. . | |
| 4,272,179 | 6/1981 | Seanor . | |
| 4,373,239 | 2/1983 | Henry et al. . | |
| 4,518,655 | 5/1985 | Henry et al. | 428/329 |
| 4,976,877 | 12/1990 | Agostinelli et al. | 219/216 |
| 5,017,432 | 5/1991 | Eddy et al. | 428/422 |
| 5,049,444 | 9/1991 | Bingham et al. | 428/339 |
| 5,061,965 | 10/1991 | Ferguson et al. | 355/284 |
| 5,157,445 | 10/1992 | Shoji et al. | 355/284 |
| 5,291,257 | 3/1994 | Cerrah et al. | 355/290 |
| 5,332,641 | 7/1994 | Finn et al. | 430/124 |
| 5,370,931 | 12/1994 | Fratangelo et al. | 428/334 |
| 5,595,823 | 1/1997 | Chen et al. | 428/421 |

FOREIGN PATENT DOCUMENTS

| | | | |
|---|---|---|---|
| 0568245 | 11/1993 | European Pat. Off. | G03G 15/20 |

*Primary Examiner*—Robert Beatty
*Attorney, Agent, or Firm*—Zosan S. Soong; Annette L. Bade

[57] ABSTRACT

A hard, long wearing, thermally conductive fuser member comprising a base member and a surface layer wherein said surface layer includes a fluoroelastomer and an alumina filler having an average particle size of from about 0.5 to about 15 micrometers, said alumina being present in an amount to provide a thermal conductivity of at least about 0.24 watts/meter °Kelvin in said surface layer.

13 Claims, 5 Drawing Sheets

THIN, THERMALLY CONDUCTIVE FLUOROELASTOMER COATED FUSER MEMBER

CROSS REFERENCE TO RELATED APPLICATIONS

This is a continuation-in-part application of U.S. patent application Ser. No. 08/411,199 filed Mar. 27, 1995, now abandoned, the disclosure of which is hereby totally incorporated by reference.

Attention is hereby directed to U.S. patent application Ser. No. 08/164,851 filed Dec. 10, 1993, now U.S. Pat. No. 5,530,536 in the name of Henry et al., and entitled "Low Modulus Fuser Member".

BACKGROUND OF THE INVENTION

The present invention relates to a fuser member and a fusing system for fusing toner images in electrostatographic printing apparatus. In particular, it relates to a thin, thermally conductive fluoroelastomer fuser member coating which, while it may be used as a pressure roll or release agent donor roll, is preferably employed as a heated fuser roll.

In a typical electrostatographic printing apparatus, a light image of an original to be copied is recorded in the form an electrostatic latent image upon a photosensitive member and the latent image is subsequently rendered visible by the application of electroscopic thermoplastic resin particles which are commonly referred to as toner. The visible toner image is then in a loose powdered form and can be easily disturbed or destroyed. The toner image is usually fixed or fused upon a support which may be a photosensitive member itself or other support sheet such as plain paper.

The use of thermal energy for fixing toner images onto a support member is well known. In order to fuse electroscopic toner material onto a support surface permanently by heat, it is necessary to elevate the temperature of the toner material to a point at which the constituents of the toner material coalesce and become tacky. This heating causes the toner to flow to some extent into the fibers or pores of the support member. Thereafter, as the toner material cools, solidification of the toner material causes the toner material to be firmly bonded to the support.

Typically, thermoplastic resin particles are fused to the substrate by heating to a temperature of between about 90° C. to about 160° C. or higher depending upon the softening range of the particular resin used in the toner. It is not desirable, however, to raise the temperature of the substrate substantially higher than about 200° C. because of the tendency of the substrate to discolor at such elevated temperatures particularly when the substrate is paper.

Several approaches to thermal fusing of electroscopic toner images have been described in the prior art. These methods include providing the application of heat and pressure substantially concurrently by various means: a roll pair maintained in pressure contact; a belt member in pressure contact with a roll; and the like. Heat may be applied by heating one or both of the rolls, plate members or belt members. The fusing of the toner particles takes place when the proper combination of heat, pressure and contact time are provided. The balancing of these parameters to bring about the fusing of the toner particles is well known in the art, and they can be adjusted to suit particular machines or process conditions.

During operation of a fusing system in which heat is applied to cause thermal fusing of the toner particles onto a support, both the toner image and the support are passed through a nip formed between the roll pair, or plate or belt members. The concurrent transfer of heat and the application of pressure in the nip effects the fusing of the toner image onto the support. It is important in the fusing process that no offset of the toner particles from the support to the fuser member takes place during normal operations. Toner particles offset onto the fuser member may subsequently transfer to other parts of the machine or onto the support in subsequent copying cycles, thus, increasing the background or interfering with the material being copied there. The so called "hot offset" occurs when the temperature of the toner is raised to a point where the toner particles liquefy and a splitting of the molten toner takes place during the fusing operation with a portion remaining on the fuser member. The hot offset temperature or degradation of the hot offset temperature is a measure of the release property of the fuser roll, and accordingly it is desired to provide a fusing surface which has a low surface energy to provide the necessary release. To insure and maintain good release properties of the fuser roll, it has become customary to apply release agents to the fuser members to insure that the toner is completely released from the fuser roll during the fusing operation. Typically, these materials are applied as thin films of, for example, silicone oils to prevent toner offset. In addition to preventing hot offset, it is desirable to provide an operational latitude as large as possible. By operational latitude it is intended to mean the difference in temperature between the minimum temperature required to fix the toner to the paper, the minimum fix temperature, and the temperature at which the hot toner will offset to the fuser roll, the hot offset temperature.

While the above described electrostatographic imaging process has been used for many years in the production of copies of original documents and prints of electronically generated images, a recent development has been the use of such a process in the preparation and printing of checks, and in particular, personal checks with the use of magnetic dry toner compositions. In these applications, the dry magnetic toner is printed on the checks indicating the checking account and other suitable identifying information including, for example, identification of the bank, etc. This information, already on the check, is subsequently read by a magnetic image character recognition (referred herein as "MICR") device and the information obtained thereby processed for various accounting purposes. U.S. Pat. No. 4,517,268 re-issued as Reissue 33,172 to Gruber et al., is an example of a basic magnetic image character recognition process together with a toner employed in such a process. In addition to the thermoplastic resinous materials in the toner, the toner contains a significant amount of magnitite particles to enable the magnetic image character recognition process. Furthermore, such a toner may contain additional additives used for various purposes including, for example, materials to control electrical properties of the toner such as titanium dioxide; surface additives such as Kynar™, a polyvinylidene fluoride available from Pennwalt Chemicals Corporation; the polyhydroxy wax, Unilin, available from Petrolite used to eliminate comets on the imaging surface. Comets are an imaging defect involving toner, or portions thereof, adhering to the imaging surface, causing a comet shaped defect.

During the magnetic character recognition process the toner image is passed through a contact reader several (up to 20) times through the complete recognition process. During the processing of checks through this process, and in addition to the normal wear and tear placed on the checks by the several mechanical sheet handling devices, the individual contact readers provide a contact pressure on the face of the check which has a tendency to smear the toner image coverage or break off portions of the toner image which in addition to contaminating the read head may also result in reading failure by the contact reader and the subsequent rejection of the check in the process together with the necessity of manually inserting the number information into the check reading apparatus. Overall, this results in poor performance of the magnetic image character recognition device resulting in increased bank charges from one bank to another. This difficulty is caused by a poor fix of the toner to the check substrate, resulting in smearing of the toner coverage together with flaking off or breaking off of the toner image during various stages of processing. This poor adhesion of the toner to the paper substrate or other check substrate results from the poor adhesion of the toner image to the substrate itself as well as the poor cohesion of the toner material itself.

In a specific embodiment, for example, in the Xerox 5090 Duplicator with a MICR toner similar to that described in U.S. Pat. No. 4,517,268 and having a fusing system including a fuser roll made of a hydrofluoroelastomer similar to that described in U.S. Pat. No. 5,017,432, when operating under normal parameters provides fixed toner images on checks, for example, wherein the contact pressure placed on the check from the contact reader results in a smear of the toner coverage as well as a flaking or breaking off of the toner particles. This poor adhesion of the MICR toner together with the poor cohesion of the toner material itself, results in a poor fix to the check substrate under normal operating conditions. This short fall in fixation or fusing may in part be due to the presence of certain additives for known purposes in the toner. One solution to this poor fixation or fusing is to increase the temperature of the fuser roll, which while it does provide a minimum fix temperature up to 30° F., for example, beyond the normal minimum fix temperature for which the fuser roll described in U.S. Pat. No. 5,017,432 was designed, it has the negative aspect, in that due to the increase in temperature, decomposition of the adhesive or the polymer at the interface between the adhesive, the core of the fuser roll and the hydrofluoroelastomer may take place resulting in degradation of the material in the fuser roll as well as the pressure roll with eventual catastrophic roll failure by rupturing of the surface layers. This is true since to increase the temperature at the surface of the fuser member, it is necessary to increase the core temperature of the fuser roll which results in a shorter life of the fuser roll by degrading the adhesive between the core and the adjacent layer such as a hydrofluoroelastomer layer.

SUMMARY OF THE INVENTION

In accordance with the present invention a fuser member and a fuser system are provided wherein the toner, and in particular a MICR toner, is sufficiently adequately fused to the substrate, such as a check substrate, so that it will not smear when contacted by a contact reader nor flake or chip off during the reading operation, while at the same time the temperature at the core of the fuser member need not be raised to a level which degrades the fuser member material or any adhesive between it and an adjacent layer or the pressure member. Furthermore, according to the present invention the toner material will be much more completely embedded in the paper substrate and the fuser member will be of sufficient hardness as well as having a surface temperature to provide both penetration of the toner and conformability of the toner to enable the toner to flow around the magnetic particles.

In a specific aspect of the present invention a hard, long wearing thermally conductive fuser member is provided wherein the fuser member comprises a base member and a surface layer wherein said surface layer includes a fluoroelastomer and an alumina filler having an average particle size of from about 0.5 to about 15 micrometers, said alumina being present in an amount to provide a thermal conductivity of at least about 0.24 watts/meter °Kelvin in said surface layer. The surface layer may comprise the bulk of the coating on the base member since in one embodiment of the present invention the only other layer is a thin adhesive layer.

There is further provided in embodiments of the present invention a fusing system for an electrostatographic printing machine comprising a pressure member and a long wearing, thermally conductive fuser member comprising a base member and a surface layer wherein said surface layer includes a fluoroelastomer and an alumina filler having an average particle size of from about 0.5 to about 15 micrometers, said alumina being present in an amount to provide a thermal conductivity of at least about 0.24 watts/meter °Kelvin in said surface layer. The pressure member in said fusing system may be a soft, sleeveless, long wearing roll comprising a cylindrical core and a nonoxidizing, nonswelling in silicone oil, layer of a thermally stable hydrofluoroelastomer having a Young's modulus of elasticity of less than about 500 lbs/in$^2$, from about 250 mils to about 500 mils in thickness and a hardness of from about 45 to about 60 Shore A. The pressure member alternatively in said fuser system may be a sleeved pressure member comprising for example a fluoroplastic sleeve such as Teflon perfluoroalkoxy resin (illustrative thickness of about 20 mils) over a layer of hydrocarbon rubber such as ethylene propylene rubber (illustrative thickness of about 0.5 inch) over a steel core (illustrative size of about 2 inches in diameter).

In accordance with a further aspect of the present invention the fluoroelastomer comprises a poly (vinylidenefluoride-hexafluoropropylene-tetrafluoroethylene-optional cure site monomer) wherein the vinylidenefluoride is present in an amount less than 40 weight percent of the polymer.

In a further aspect of the present invention the fluoroelastomer has been cured from a solvent solution thereof with a nucleophilic curing agent and in the presence of less than 4 parts by weight of inorganic base per hundred parts by weight of polymer with the inorganic base being effective to at least partially dehydrofluorinate the vinylidenefluoride.

In a further aspect of the present invention the alumina is present in the surface layer in an amount of from about 30 parts to about 100 parts by weight and preferably about 40 parts by weight to 70 parts by weight and most preferably about 55 parts by weight per 100 parts by weight of the fluoroelastomer.

In a further aspect of the present invention cupric oxide is present in the surface layer in an amount up to about 30 parts by weight and preferably 2 to 18 parts by weight per 100 parts by weight of the fluoroelastomer.

In a further aspect of the present invention the alumina has a particle size distribution of from about 0.5 micron to about 8 microns.

In a further aspect of the present invention the surface layer of the fuser member has a hardness of from about 75 to about 90 and preferably about 82 Shore A.

In a further aspect of the present invention the surface layer is from about 4.5 to about 9 mils in thickness and preferably about 6 mils in thickness.

In a further aspect of the present invention an adhesive layer is included between the core and the fluoroelastomer surface layer.

DETAILED DESCRIPTION OF THE PRESENT INVENTION

While the following discussion of the alumina filler is primarily in terms of calcined alumina, all other types of alumina filler such as tabular alumina, fumed alumina, and fused alumina may be used in addition to or in place of the calcined alumina. As discussed in more detail herein, the alumina filler in the surface layer of the fuser member may be of only one type or a mixture of two or more alumina types selected from the group consisting of for example calcined alumina, tabular alumina, fumed alumina, and fused alumina. The alumina filler particles may be of either alpha or gamma crystalline type. Unless otherwise indicated, fused alumina, fumed alumina, tabular alumina, or a mixture of different types of alumina may be used in the same or similar amounts and particle sizes as calcined alumina, and provide the same or similar advantages as calcined alumina in the surface layer of the fuser member.

While the following discussion is primarily in terms of a hydrofluoroelastomer, other suitable fluoroelastomers such as FFKM elastomers may be used.

As used herein, the phrase average particle size as used in connection with the alumina filler refers to the median volume average which is a point on a histogram describing particle size volume distribution. It is the point on the scale of observations which has equal area under the histogram on either side.

Figure 1:
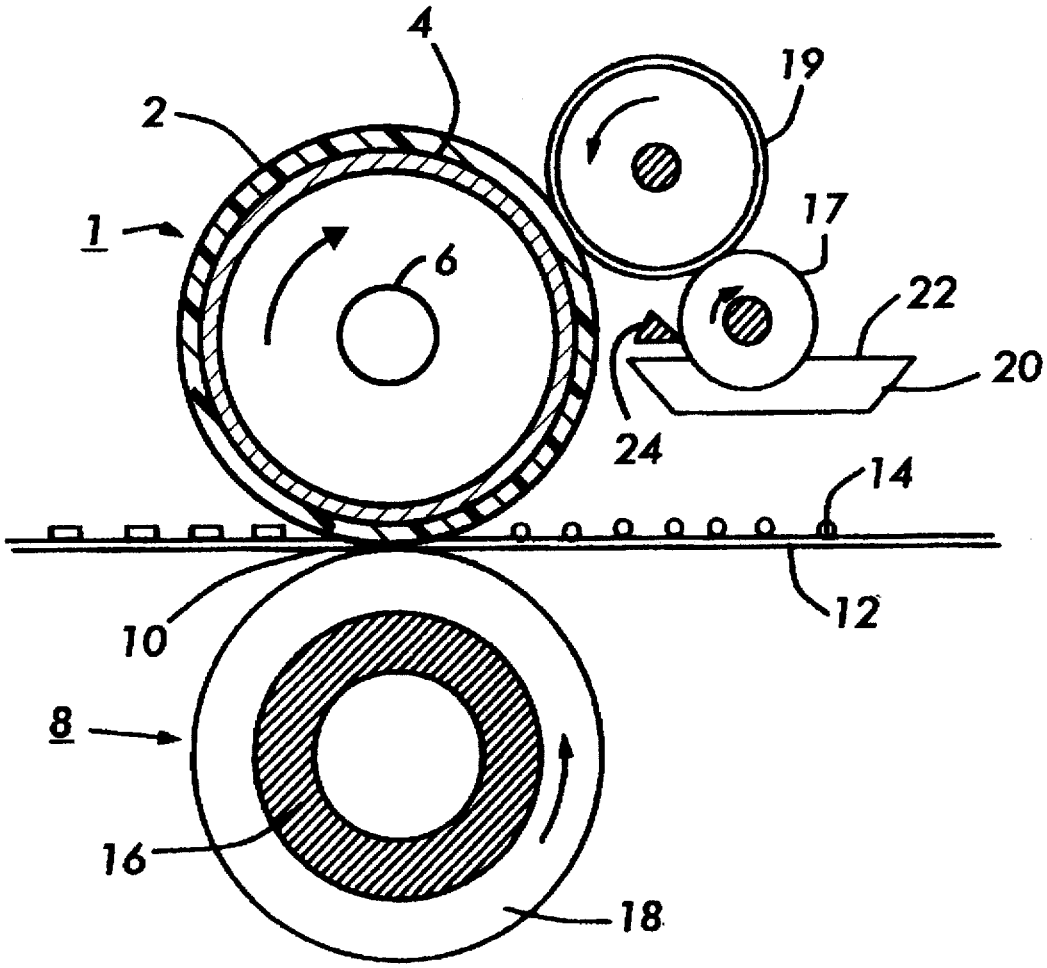
FIG. 1 is a sectional view of a fuser system which may use the fuser member according to the present invention.

A typical fuser member of the present invention is described in conjunction with a fuser assembly as shown in FIG. 1 where the numeral 1 designates a fuser roll comprising elastomer surface 2 upon suitable base member 4 which is a hollow cylinder or core fabricated from any suitable metal such as aluminum, anodized aluminum, steel, nickel, copper, and the like, having a suitable heating element 6 disposed in the hollow portion thereof which is coextensive with the cylinder. Backup or pressure roll 8 cooperates with fuser roll 1 to form a nip or contact arc 10 through which a copy paper or other substrate 12 passes such that toner images 14 thereon contact elastomer surface layer 2 of fuser roll 1. As shown in FIG. 1, the backup roll 8 has a rigid hollow steel core 16 with a soft surface layer 18 thereon. Sump 20 contains polymeric release agent 22 which may be a solid or liquid at room temperature, but is a fluid at operating temperatures.

In the embodiment shown in FIG. 1 for applying the polymeric release agent 22 to elastomer surface layer 2, two release agent delivery rolls 17 and 19 rotatably mounted in the direction indicated are provided to transport release agent 22 from the sump 20 to the elastomer surface layer. As illustrated in FIG. 1, roll 17 is partly immersed in the sump 20 and transports on its surface release agent from the sump to the delivery roll 19. By using a metering blade 24 a layer of polymeric release fluid can be applied initially to the delivery roll 19 and subsequently to elastomer surface layer 2 in controlled thickness ranging from submicrometer thickness to thickness of several micrometers of release fluid. Thus, by metering device 24 about 0.1 to 2 micrometers or greater thickness of release fluid can be applied to the surface of elastomer surface layer 2.

The fuser member may be a roll, belt, flat surface or other suitable shape used in the fixing of thermoplastic toner images to a suitable substrate. Typically, the fuser member is made of a hollow cylindrical metal core, such as copper, aluminum, steel and like, and has an outer layer of the selected cured fluoroelastomer. Alternatively, there may be one or more thermally conductive intermediate layers between the substrate and the outer layer of the cured elastomer if desired. Typical materials having the appropriate thermal and mechanical properties for such intermediate layers include thermally conductive (e.g., 0.59 watts/meter/°Kelvin) silicone elastomers such as high temperature vulcanizable ("HTV") materials and liquid silicone rubbers ("LSR"), which may include an alumina filler in the amounts described herein. The silicone elastomer may have a thickness of about 2 mm (radius). An HTV is either a plain polydimethyl siloxane ("PDMS"), with only methyl substituents on the chain, ($OSi(CH_3)_2$) or a similar material with some vinyl groups on the chain ($OSi(CH{=}CH_2)(CH_3)$). Either material is peroxide cured to create crosslinking. An LSR usually consists of two types of PDMS chains, one with some vinyl substituents and the other with some hydride substituents. They are kept separate until they are mixed just prior to molding. A catalyst in one of the components leads to the addition of the hydride group ($OSiH(CH_3)$) in one type of chain to the vinyl group in the other type of chain causing crosslinking.

In accordance with the present invention a fusing system including a fusing member is provided wherein the surface layer of the fusing member comprises an fluoroelastomer filled with an alumina filler having an average particle size of from about 0.5 to about 15 micrometers present in an amount to provide a thermal conductivity of at least 0.24 watts/meter °Kelvin in the surface layer together with a hardness of from about 75 to about 90 and preferably about 82 Shore A. Typically the surface layer of the fuser member is from about 4 to about 9 mils and preferably 6 mils in thickness as a balance between conformability and cost and to provide thickness manufacturing latitude. Such a fusing system and fuser member have been found to provide sufficient hardness to the fuser member to enable penetration of the magnetic particles in the toner into the paper substrate such as check material while at the same time providing sufficient conformability of the thermoplastic resin to enable flow of the toner material around the individual magnetic particles. The hardness of the surface layer of the fuser member is greatly increased by increasing amounts of the alumina filler which enables embedding the toner as much as possible into the paper substrate. Furthermore, the harder the coating surface of the fuser member the greater the penetration of the toner into the paper.

Suitable fluoroelastomers include FFKM elastomers and hydrofluoroelastomers. Illustrative FFKM elastomers are perfluororubbers of the polymethylene type having all substituent groups on the polymer chain either fluoro, perfluoroalkyl, or perfluoroalkoxy groups. The hydrofluoroelastomers (also known as FKM elastomers), according to the present invention, are those defined in ASTM designation D1418-90 and are directed to fluororubbers of the polymethylene type having substituent fluoro and perfluoroalkyl or perfluoroalkoxy groups on a polymer chain.

The fluoroelastomers useful in the practice of the present invention are those described in detail in U.S. Pat. No. 4,257,699 to Lentz, as well as those described in commonly assigned U.S. Pat. Nos. 5,017,432 to Eddy et al. and 5,061,965 to Ferguson et al. As described therein, these fluoroelastomers, particularly from the class of copolymers, terpolymers, and tetrapolymers of vinylidenefluoride hexafluoropropylene, tetrafluoroethylene, and cure site monomer (believed to contain bromine) known commercially under various designations as Viton A, Viton E60C, Viton E430, Viton 910, Viton GH, Viton GF and Viton F601C. The Viton designation is a Trademark of E.I. DuPont deNemours, Inc. Other commercially available materials include Fluorel 2170, Fluorel 2174, Fluorel 2176, Fluorel 2177 and Fluorel LVS 76, Fluorel being a Trademark of 3M Company. Additional commercially available materials include Aflas a poly(propylene-tetrafluoroethylene) copolymer, Fluorel II a poly(propylene-tetrafluoroethylene-vinylidenefluoride) terpolymer both also available from 3M Company. Also, the Tecnoflons identified as FOR-60KIR, FOR-LHF, NM, FOR-THF, FOR-TFS, TH, TN505 are available from Ausimont Chemical Co. Typically, these fluoroelastomers can be cured with a nucleophilic addition curing system, such as a bisphenol crosslinking agent with an organophosphonium salt accelerator as described in further detail in the above referenced Lentz Patent, and in the Eddy et al. patent or with a peroxide as described in DuPont's literature in which case a cure site monomer such as bromomethyl perfluorovinyl ether is also necessary.

A particularly preferred embodiment of the hydrofluoroelastomer is that described in U.S. Pat. No. 5,017,432 to Eddy et al. which provides a fuser member surface layer comprising poly(vinylidenefluoride-hexafluoropropylene-tetrafluoroethylene-cure site monomer believed to contain bromine) wherein the vinylidenefluoride is present in an amount less than 40 weight percent and which is cured from a dried solvent solution thereof with a nucleophilic curing agent soluble in the solvent solution and in the presence of less than 4 parts by weight inorganic base per 100 parts of polymer, the inorganic base being effective to at least partially dehydrofluorinate the vinylidenefluoride, which is described in greater detail in U.S. Pat. No. 5,017,432 and the nucleophilic curing system is further described in greater detail in U.S. Pat. No. 4,272,179 to Seanor and U.S. Pat. No. 4,264,181 to Lentz et al.

Figure 4:
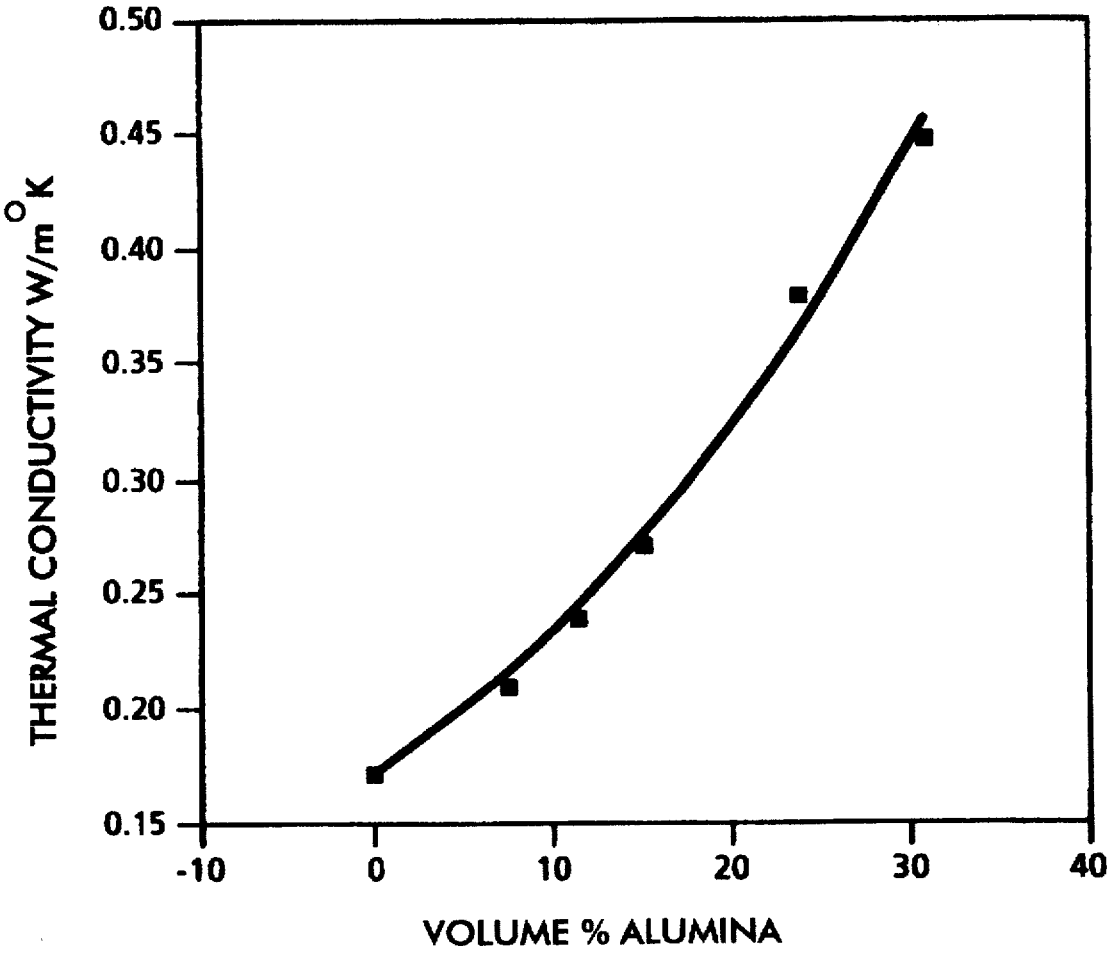
FIG. 4 is a graphical representation of the increase in thermal conductivity with an increasing percentage of the volume of the calcined alumina filler per volume of the elastomeric material.

According to the present invention the fluoroelastomer is filled with alumina such as calcined alumina to provide the desired hardness, thermal conductivity and conformability of the surface of the fuser member. Calcined alumina is alumina heated to a temperature below 3700° F. which prevents fusion from taking place but still allows water to be driven off. This produces a highly surface active filler which in combination with an average particle size of from about 0.5 to 15 micrometers and preferably 1 to 9 micrometers, provides the desired thermal conductivity, hardness and conformability of the fuser layer. While the 1 micrometer and 9 micrometer sizes provide approximately the same results in filler performance, in order to provide a more processable material and minimize problems with filler size, it is preferred to use a filler having a nominal size of about 1 micrometer. The thermal conductivity of the surface layer is at least about 0.24 watts/meter °Kelvin to provide an acceptable fix with good adhesion of the toner to the substrate which as seen from FIG. 4 is achieved at about 11 volume % of calcined alumina in the total volume of the surface layer. This corresponds to about 30 parts by weight of calcined alumina per 100 parts by weight of fluoroelastomer. In a particularly preferred embodiment achieving a good balance between good adhesion and conformability on the one hand and hardness on the other hand the surface layer has about 20% by volume of the total volume of calcined alumina or 55 parts by weight of calcined alumina per 100 parts by weight fluoroelastomer providing a thermal conductivity of about 0.31 watts/meter °Kelvin. Generally the calcined alumina filler may be present in the FKM surface layer in an amount of from about 30 parts by weight to about 100 parts and preferably from about 40 to about 70 parts by weight per 100 parts by weight of the fluoroelastomer. A particularly preferred amount of calcined alumina in providing the best balance between thermal conductivity and hardness is about 55 parts by weight per 100 parts by weight of the fluoroelastomer. Such formulations with only the calcined alumina present to provide the thermal conductivity and no additional filler are typically employed in fusing systems with toner release agents which do not require the use of anchoring sites of metal oxide particles. Such toner release agents include the aminofunctional release agents described in U.S. application Ser. No. 08/314,759 filed Sep. 29, 1994, now U.S. Pat. No. 5,531,813.

An option according to the present invention and a further preferred embodiment includes the use of metal oxide filler particles as anchoring sites for a functional toner release agent. The preferred embodiment includes up to about 30 parts by weight, preferably about 12 to 18 parts and most preferably 15 parts by weight of copper oxide (cupric oxide) in the surface layer per 100 parts by weight of the fluoroelastomer which is useful in a fusing system in conjunction with a functional release agent and in particular a mercapto functional oil as described in U.S. Pat. No. 4,029,827 to Imperial et al. In this embodiment the cupric oxide particles providing the anchoring sites for the functional release agent are provided in the total filler constituents of the surface layer in about a volume for volume substitution of the cupric oxide for the alumina. It is important that in all embodiments the amount of total filler including alumina and any cupric oxide as well as additional filler material not be present in such a large amount as to make the surface layer so hard that acceptable conformity of the toner around the magnetic particles is not achieved.

FIG. 4 illustrates that over the range of the data provided the increase in thermal conductivity with increasing volume percent of calcined alumina in the surface layer can be fit by a quadratic equation with excellent statistical certainty. Thus, predictions of thermal conductivity from knowledge of the volume percent of alumina can easily be made over this range. The inverse prediction can also be made.

The particle size described herein for the alumina filler is an important factor contributing to improved release of the toner from the fuser member, thereby minimizing or eliminating the hot offset phenomenon wherein toner adheres to the surface of the fuser member and such residual toner subsequently being transferred to a copy sheet. The alumina filler in the surface layer of the fuser member may be of only one type of alumina or a mixture of two or more types of alumina selected for example from calcined alumina, fumed alumina, fused alumina, and tabular alumina. Any suitable mixture ratio can be used such as from about 95% to 5% of one alumina type and from about 5% to about 95% for the second alumina type for a two component mixture. The various alumina types can be used individually or in any combination, where illustrative mixtures include calcined alumina/tabular alumina; tabular alumina/fused alumina; fumed alumina/calcined alumina; and calcined alumina/tabular alumina/fused alumina. Mixtures of different alumina types, fused alumina alone, fumed alumina alone, or tabular alumina alone all may be as effective as the use of only calcined alumina in the present fuser member because the various types of alumina all have the same or similar thermal conductivity value of 25 watts/meter °Kelvin. Anhydrous alumina is preferred. Fused alumina is prepared by heating alumina to about 4172° F. (above its melting point of 3761° F.), cooling, and then grinding the alumina to the desired particle size. Fumed alumina is made by the high temperature oxidation of aluminum chloride which results in submicron particles of aluminum oxide. The calcined alumina according to the present invention is to be distinguished from tabular alumina, which is a sintered alumina that has been heated to a temperature slightly below 3700° F., the fusion point of aluminum oxide. The name "tabular" comes from the fact that the material is composed predominantly of table-like crystals. Tabular alumina having an average particle size of about 5 to 7 microns is available from Alcoa (designation of –20 micron alumina).

Other adjuvents and fillers may be incorporated in the elastomer in accordance with the present invention as long as they do not affect the integrity of the elastomer, the interaction between the metal oxide and the polymeric release agent or prevent the appropriate crosslinking of the elastomer. Such fillers normally encountered in the compounding of elastomers include coloring agents, reinforcing fillers, crosslinking agents, processing aids, accelerators and polymerization initiators.

The nucleophilic curing system with the bisphenol crosslinking agent and organophosphonium salt accelerator is described in U.S. Pat. No. 4,272,179. However, according to the present invention the nucleophilic curing agent (crosslinking agent and accelerator) is soluble or suspendable in a solvent solution of the polymer (for example VITON GF) and is used in the presence of less than 4 parts by weight of inorganic base (e.g., $Ca(OH)_2$ and MgO) per 100 parts by weight of polymer. Normally, the tetrapolymers of vinylidenefluoride hexafluoropropylene and tetrafluoroethylene are peroxide cured. However, as previously discussed the preferred fabricating procedure for a fuser member is to spray a solvent solution of the polymer onto a substrate thereby rendering peroxide curing in air difficult since the peroxide preferentially reacts with oxygen in the air or residual solvent rather than curing the polymer. The preferred alternative curing system is a nucleophilic curing system such as a bisphenol crosslinking agent and an organophosphonium salt accelerator. Typically, the curing process takes place in the presence of 8 to 10 parts by weight of inorganic base per 100 parts of polymer. The inorganic base dehydrofluorinates the vinylidenefluoride in the polymer creating double bonds which act as reactive sites for crosslinking. However, the presence of excess base results in the long term degradation of the elastomers and if excess base continues to dehydrofluorinate the vinylidenefluoride generating double bonds which cause the fuser member to harden, subsequent oxidation causes the surface energy to increase and the release performance to degrade. Thus, it is preferred to cure the polymer at a relatively low base level to control the reactivity of the vinylidene fluoride. The typical curing agents such as Viton Curative No. 30 which is about 50 percent by weight bisphenol AF and 50 percent by weight poly(vinylidenefluoride-hexafluoropropylene) and Viton Curative No. 20 which is about one third triphenyl benzyl phosphonium chloride and two thirds poly (vinylidenefluoride-hexafluoropropylene) both available from E.I. DuPont deNemours Company will not function as curing agents at low base levels. While the exact reason for this is not clear, it is believed to be at least in part due to the fact that Curative No. 20 is not soluble in the solvent solution of the polymer and therefore is not in close proximity to many of the smaller number of reactive sites for crosslinking performed by the dehydrofluorination of the vinylidenefluoride. While Curative Nos. 20 and 30 do not function effectively at low base levels, we have surprisingly found that another Viton Curative, Curative No. 50 also available from E.I. DuPont deNemours which is normally used with high base levels can be used to cure poly (vinylidenefluoride-hexafluoropropylene-tetrafluoroethylene) at less than one half its normal base level or less than about 4 parts by weight per 100 parts of polymer. Since the Curative No. 50 is soluble in the solvent solution of the polymer at low base levels it is readily available at the reactive sites for crosslinking. The Viton Curative No. 50 incorporates an accelerator (a quarternary phosphonium salt or salts) and a crosslinking agent, bisphenol AF into a single curative system.

The fuser member of the present invention is preferably a roll, preferably one prepared by applying either in one application or successively applying to the surface to be coated thereon, a thin coating or coatings of the elastomer with alumina filler dispersed therein. Coating is most conveniently carried out by spraying, dipping, or the like a solution or homogeneous suspension of the elastomer containing the filler. While molding, extruding and wrapping techniques are alternative means which may be used, we prefer to spray successive applications of a solvent solution of the polymer, alumina and other metal oxide filler, if any, to the surface to be coated. Typical solvents that may be used for this purpose include methyl ethyl ketone, methyl isobutyl ketone and the like. When successive applications are made to the surface to be coated it is generally necessary to heat the film coated surface to a temperature sufficient to flash off any solvent contained in the film. For example, when a fuser roll is coated with an elastomer layer containing metal oxide, the elastomer having metal oxide dispersed therein is successively applied to the roll in thin coatings and between each application evaporation of the solvent in the film coated on the roll is carried out at temperatures of at least 25° C. to about 90° C. or higher so as to flash off most of the solvent contained in the film. When the desired thickness of coating is obtained, the coating is cured and thereby bonded to the roll surface. Typically, the coating is cured by a stepwise heating process of about 24 hours such as 2 hours at 95° C., 2 hours at 150° C., 2 hours at 175° C., 2 hours at 200° C. and 16 hours at 230° C., followed by cooling and sanding.

A typical formulation for the surface layer of the fuser member includes:

- 100 parts by weight of the hydrofluoroelastomer available from E.I. DuPont or 3M
- 30 to 75 parts by weight of the calcined alumina available from K. C. Abrasives
- 1 part by weight of $Ca(OH)_2$ available from J. T. Baker
- 2 parts by weight MgO, Maglite D available from C. P. Hall
- 2 parts by weight carbon black N990 available from R. T. Vanderbilt Co.

5 parts by weight of DuPont VC50 available from E.I. DuPont

Optionally up to 30 parts by weight cupric oxide available from American Chemet as product number 13600 may be included.

The thermally conductive hard surface layer of the fuser member containing the fluoroelastomer together with the alumina filler is present in a thickness of from about 4 to about 9 mils and preferably 6 mils which provide a suitable balance between conductivity and conformability. Below about 4 mils the conformability of the surface layer decreases to a point where it shows no more conformability than the metal core while above the optimum of 6 mils the issue is not one of performance, but rather one of relative cost of the materials in the layer.

The fuser member according to the present invention, which in a specific embodiment is an internally heated fuser roll, may be used in a fusing system with or without a functional oil as a toner release agent. In the event that a mercapto functional oil is desired to be used the fusing surface should contain appropriate anchor sites such as metal oxide particles. In this regard, attention is directed to the above referenced Lentz et al., Lentz and Seanor patents, which describe fuser members and methods of fusing thermoplastic resin toner images to a substrate wherein the polymeric release agent having functional groups is applied to the surface of the fuser member. In a preferred embodiment of the present invention a mercapto functional oil may be used as a release agent in conjunction with cupric oxide anchoring sites in the fusing surface. On the other hand, and in another preferred embodiment of the present invention, an aminofunctional toner release agent is used, which, because it has functional amino groups which react with the fluoroelastomer surface, may be used without anchoring sites such as metal oxide particles like cupric oxide in the surface of the fuser member. Such aminofunctional release agents include those described in U.S. Ser. No. 08/314,759 filed Sep. 29, 1994, now U.S. Pat. No. 5,531,813 the disclosure of which is totally incorporated by reference. Preferred amino functional release agents are also disclosed in Shoji et al., U.S. Pat. No. 5,157,445, the disclosure of which is totally incorporated by reference.

Preferred mercapto functional silicone release agents are disclosed in Imperial et al., U.S. Pat. No. 4,029,827, the disclosure of which is totally incorporated by reference. A typical mercapto functional polysiloxane backbone is of the dialkyl type having the general formula:

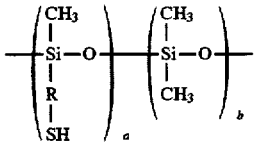

wherein R represents a "spacer" group pendant from the polymer backbone and SH is the mercapto functional group. In preferred embodiments R is an alkyl moiety having about 1–8 carbon atoms typically a propyl group (—$CH_2$—$CH_2$—$CH_2$—). For a typical polymer having a 1 mole percent functional content, there is 1 a moiety for every 99 b's. If the mercapto functional group content is 2 mole percent, there is an average of 2 a moieties for every 98 b moieties. In embodiments, a may range from about 2 to about 4, and preferably 3; b is at least about 65, preferably from about 65 to about 200, more preferably from about 135 to about 200, and especially over about 200. The R spacer groups may be all similar for example, methyl, ethyl or propyl, or they may be mixtures or alkyl groups, for example, mixtures of propyl and butyl or ethyl and propyl, and the like. Furthermore, the R spacer group may be straight chain or branched. The typical molecule shown in the general formula above comprises methyl groups substituted on the Si atoms in non-spacer group sites. However, these non-spacer group sites may typically comprise general alkyl groups from about 1 to 6 carbons and mixtures thereof. Other groups may be substituted at these sites by one skilled in the art as long as the substituted groups do not interfere with the mercapto functional groups designated in the general formula by —SH. The R—SH groups may be randomly positioned in the molecule to provide the functional groups critical in the release agents, processes and devices of the present invention. Alternatively, or in addition, the mercapto functional groups (—SH) may be located on spacer groups (R) at terminal sites on the molecule, i.e., the molecule may be "end-capped" by the mercapto functional groups.

The polymeric release agent may also be applied in conjunction with a cutting or dilution agent with which it is miscible, that is, as two or more miscible components. An example of this embodiment is a mixture of the polydimethylsiloxane having functional mercapto groups attached to a propyl spacer group mixed with the polydimethylsiloxane (silicone oil) with which it is miscible and which acts as a dilution agent. Typical blends include 50/50 and 25/75 mercapto functional release material to silicone oil. Generally, in accordance with the objects of the present invention, the amount sufficient to cover the surface must be that amount which will maintain a thickness of the fluid in a range of submicron to microns and is preferably from about 0.5 micron to about 10 microns in thickness. The molecular weight of the polyalkyl siloxane fluids containing chemically reactive mercapto functional groups must be sufficiently high so that the fluid is not too volatile. Molecular weights on the order of 5,000 have been found satisfactory with preferred molecular weights being about 10,000 to 15,000 and higher.

In certain embodiments, mercapto functional silicone release oils are preferred over amino functional release oils. It has been observed that MICR ink (MICR ink may be a dry ink which can be on a ribbon) characters from thermal encoders may not stick to the surface of copies previously fused with an amino functional release agent. The problem has been traced to amine-cellulose interactions, which inhibit oil diffusion into the paper bulk. The absence of cellulose interactions with nonfunctional and mercapto functional silicone oils enable diffusion of these fluids into the bulk of the paper. MICR ink can then bond to exposed paper fibers. In particular, experiments indicate that amine, but not mercapto functionality, for the release oil, bonds to paper cellulose fibers. Surface measurements (ESCA) have detected high silicone content on paper that has been through a fuser employing amino fluid. Nonfunctional and mercapto release fluids show significantly less silicone at the paper surface as these fluids are capable of rapid diffusion into the paper. NMR spectroscopy has detected a specific interaction between the paper cellulose fibers and the amine, but not with the mercapto, functionality. Measurements on amine functional oil filtered through a cellulose bed show a significant adsorption of amine groups. This adsorption is manifested by a significant reduction in amine content in the filtrate. This finding suggests that there is either a hydrogen bonding interaction between the basic amine groups and the cellulose hydroxy groups or, more likely, the amine groups react with cellulose. In contrast to the amine-functionalized silicone fluid, the mercapto fluid shows no such interactions and passes through the cellulose column without any loss of functionality. Thus, mercapto functional release oil can react with the alumina filler in the surface layer of the fuser member and thereby provides excellent surface coverage, which enables long release life and long fuser member life. Yet the mercapto functional oil has little or no reaction with paper components so that the paper surface is not covered with a layer of oil, which may prevent adhesion of MICR ink. The mercapto functionality can be terminal, pendant, or both.

To promote adhesion between the fuser member core and the hydrofluoroelastomer surface layer, an adhesive, and in particular a silane adhesive, such as described in U.S. Pat. No. 5,049,444 to Bingham et al. entitled "Silane Adhesive System For Fusing Member" which includes a copolymer of vinylidenefluoride, hexafluoropropylene and at least 20 percent by weight of a coupling agent which comprises at least one organo functional silane and an activator may be used. In addition, for the higher molecular weight hydrofluoroelastomers such as, for example, Viton GF, the adhesive may be formed from the FKM hydrofluoroelastomer in a solvent solution together with an amino silane represented by the formula as described in U.S. Pat. No. 5,332,641:

$$[R'-(O)_q]_h\overset{(R)_b}{\overset{|}{Si}}-Y$$

where R can be an alkyl group having 1 to 7 carbon atoms; R' can be an alkyl group having 1 to 7 carbon atoms or a polyalkoxyalkyl group of less than 7 carbon atoms; Y is an amino group or an amino substituted alkyl, or a polyamino substituted alkyl, or an alkenylalkoxy amino, or an aryl amino group of less than 15 carbon atoms, h is 1 to 3, b is 0 to 2, q is 1 or 2 and h+b=3.

As previously discussed, the outer surface layer of the fuser member according to the present invention may be from about 4 to 9 mils and preferably is about 6 mils in thickness to provide the desired thermal conductivity and conformability. As previously pointed out, below about 4 mils difficulty is experienced in providing adequate conformability to enable the flow of toner around the magnetically attractable particle and into the paper to fix the toner. In addition to providing adequate conformability, such a thickness of the surface layer of the fuser member together with the loading of the alumina in the amounts previously indicated, provide a surface layer having a hardness to enable penetration of the toner particles into the paper surface. Furthermore, while providing acceptable conformability and hardness the presence of the alumina enables the surface layer of the fuser member to be more conductive and provide a lower (about 30° F.) minimum fix temperature as well as a lower temperature of the core of the fuser member resulting in less degradation of the fluoroelastomer surface layer and/or the interface and adhesive between the core and the fluoroelastomer surface layer.

Figure 2:
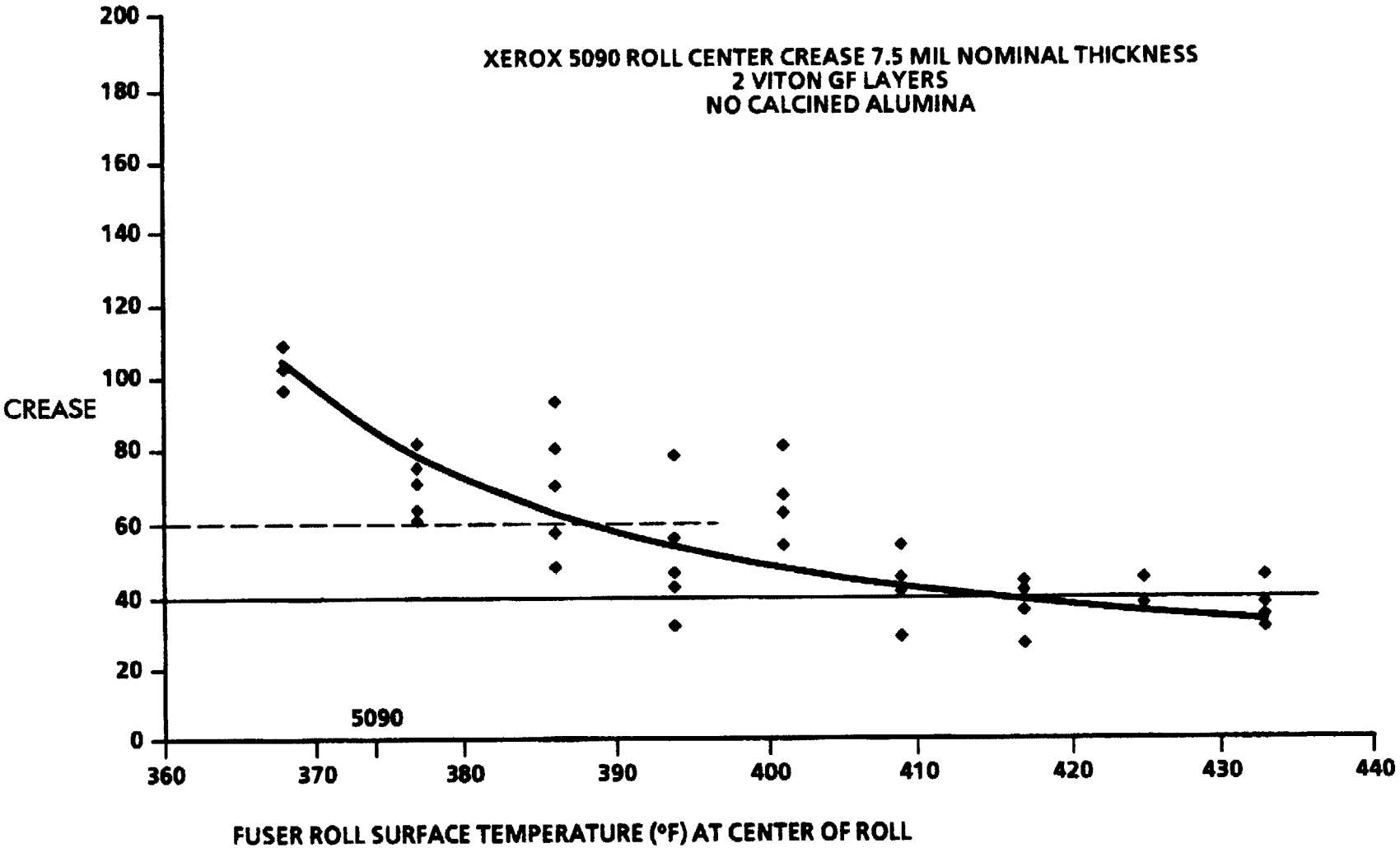
FIG. 2 (PRIOR ART)
FIG. 2 is a graphical representation of the crease area test versus fuser roll temperature of a fusing system having a fuser roll similar to that described in U.S. Pat. No. 5,017,432.
Figure 3:
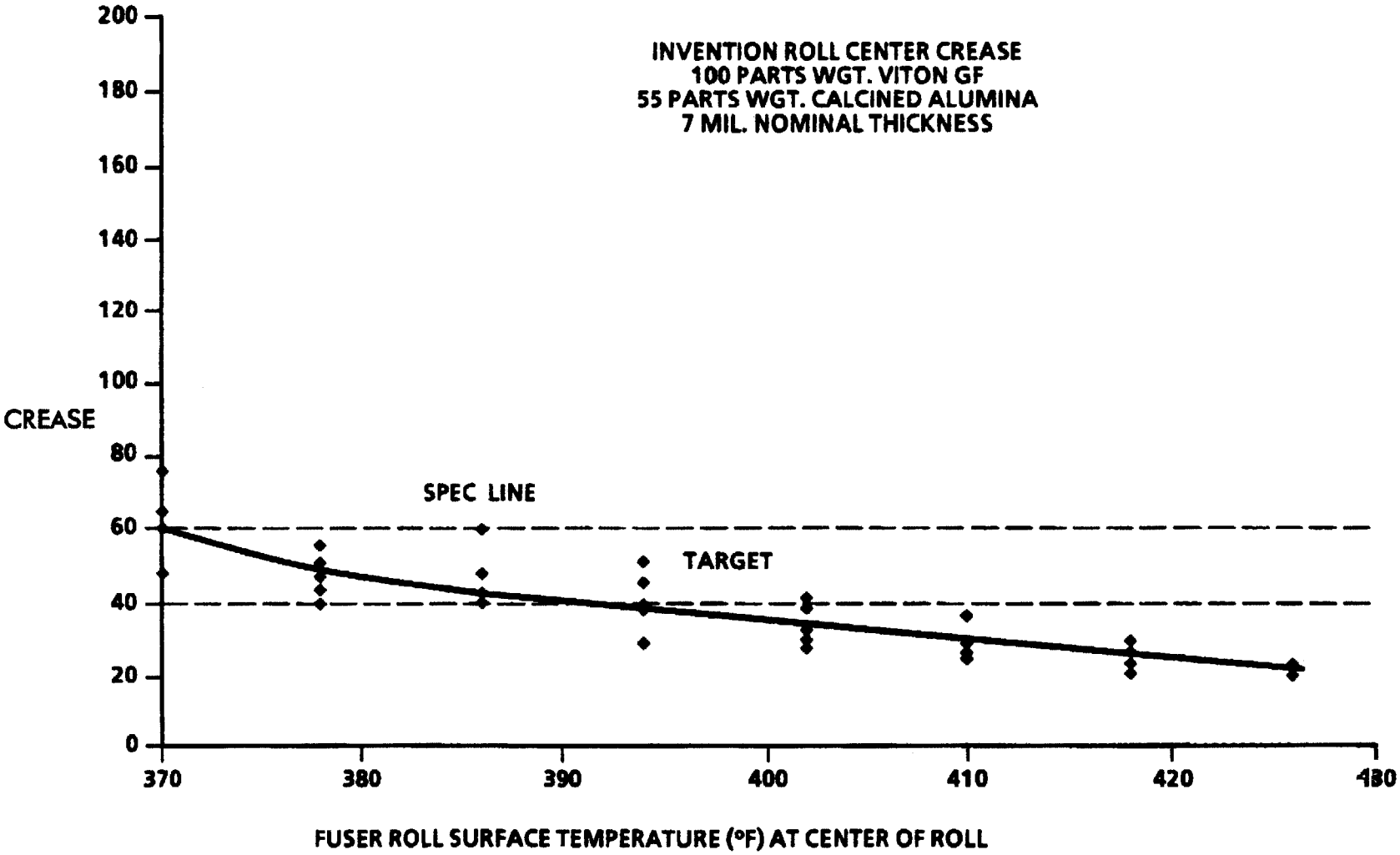
FIG. 3 is a similar graphical representation of the crease area test together with a fusing system employing a fuser member according to the present invention.

Attention is now directed to FIGS. 2 and 3 which illustrate an evaluation used to measure the fix of a toner to the substrate and in this context the fix is intended to define the penetration or embedding of toner as much as possible into the substrate such as paper. In the test, the crease area is a measure of the fix with the lower the crease area the better the fix. This is a test of fused toner to a substrate to measure how much of the toner material is flaked or chipped off at any particular point in time and is measured by folding a substrate sheet with a broad band of fixed toner on it and separating it to determine how much toner may be dislodged from the sheet substrate leaving white areas. The poorer the fix of the toner to the substrate the larger the white area and the larger the crease number. In the graphs of FIGS. 2 and 3 an acceptable fix is one with a crease area less than about 40 on each of the graphs. As may be observed, the fuser roll according to the invention, provides an acceptable fix at a surface temperature of just over 390° F., compared to the prior art of almost 420° F.

The following examples further define and describe the fusing member according to the present invention and illustrate a preferred embodiment of the present invention. In the examples which follow all parts and percentages are by weight unless otherwise specified and the testing was conducted under the same conditions including fusing speed, nip width and the pressure roll unless otherwise specified.

EXAMPLE I

A fuser roll was prepared using a cylindrical stainless steel fuser roll core about 3 inches in diameter and 16 inches long which was degreased, grit blasted, degreased and covered with a silane adhesive as described in U.S. Pat. No. 5,332,641. The fusing layer was prepared from a solvent solution/dispersion containing 100 parts by weight of an hydrofluoroelastomer, Viton GF, a polymer of 35 weight percent vinylidenefluoride, 34 weight percent hexafluoropropylene and 29 weight percent tetrafluoroethylene and 2 weight percent of a copolymerized cure site monomer. 1 part by weight of $Ca(OH)_2$, 2 parts by weight of magnesium oxide, Maglite D available from C. P. Hall, Chicago, Ill., 2 parts by weight of carbon black N990 available from R. T. Vanderbilt Co. and 5 parts by weight of duPont Curative No. 50 in a mixture of methylethyl ketone and methylisobutyl ketone which was sprayed upon the 3 inch cylindrical roll to a nominal thickness of about 6 mils and the coated fuser member was cured by stepwise heating in air at 95° C. for 2 hours, 175° C. for 2 hours, 205° C. for 2 hours and 230° C. for 16 hours. The cured fuser roll was tested in a Xerox 5090 wherein a large solid area toner image was formed on a paper substrate and evaluated for fix according to the above described crease test for surface temperatures of the fuser roll as indicated in FIG. 2. As previously discussed, the lower crease area, which is a measure of the flaking off or breaking off of the toner particles and the area creased and thereby a measure of the level of fix of the toner by way of penetration or embedding into the surface of the paper substrate is taken at that temperature of the surface of the fuser roll where the crease area is less than 40 on the ordinate scale.

EXAMPLE II

The procedure of Example I is repeated except that the fuser layer is prepared from a methylethyl ketone and methylisobutyl ketone solution of 100 parts by weight of Viton GF, 55 parts by weight of calcined alumina, 1 micrometer nominal size, available from K. C. Abrasives as #1 Calcined Alumina which provides about 20 volume percent of alumina in the fuser coating of the fuser roll, one part by weight $Ca(OH)_2$, 2 parts by weight magnesium oxide, Maglite D, 2 parts by weight carbon black N990, 5 parts by weight of Viton Curative VC50. The crease area of solid area toner images was evaluated in the same manner as in Example I and as shown at FIG. 3, a fusing layer surface temperature of just over 390° F. provided a crease area of 40 or less. In the graph of FIG. 3 representing the calcined alumina according to the present invention the conductivity of the roll matrix enables more heat to go to the surface of the roll thereby providing more heat to go to the toner/paper substrate interface.

EXAMPLE III

The procedure of Example II is repeated except that the filler was 46 parts by weight calcined alumina and 15 parts by weight cupric oxide available from American Chemet Company. A fuser roll prepared according to this procedure has a hardness and thermal conductivity similar to that obtained for the roll described in Example II and can be used in a toner fusing environment with a functional release agent such as a silicone oil having mercapto functionality. The cupric oxide will act as an anchoring site for such a release agent.

Figure 5:
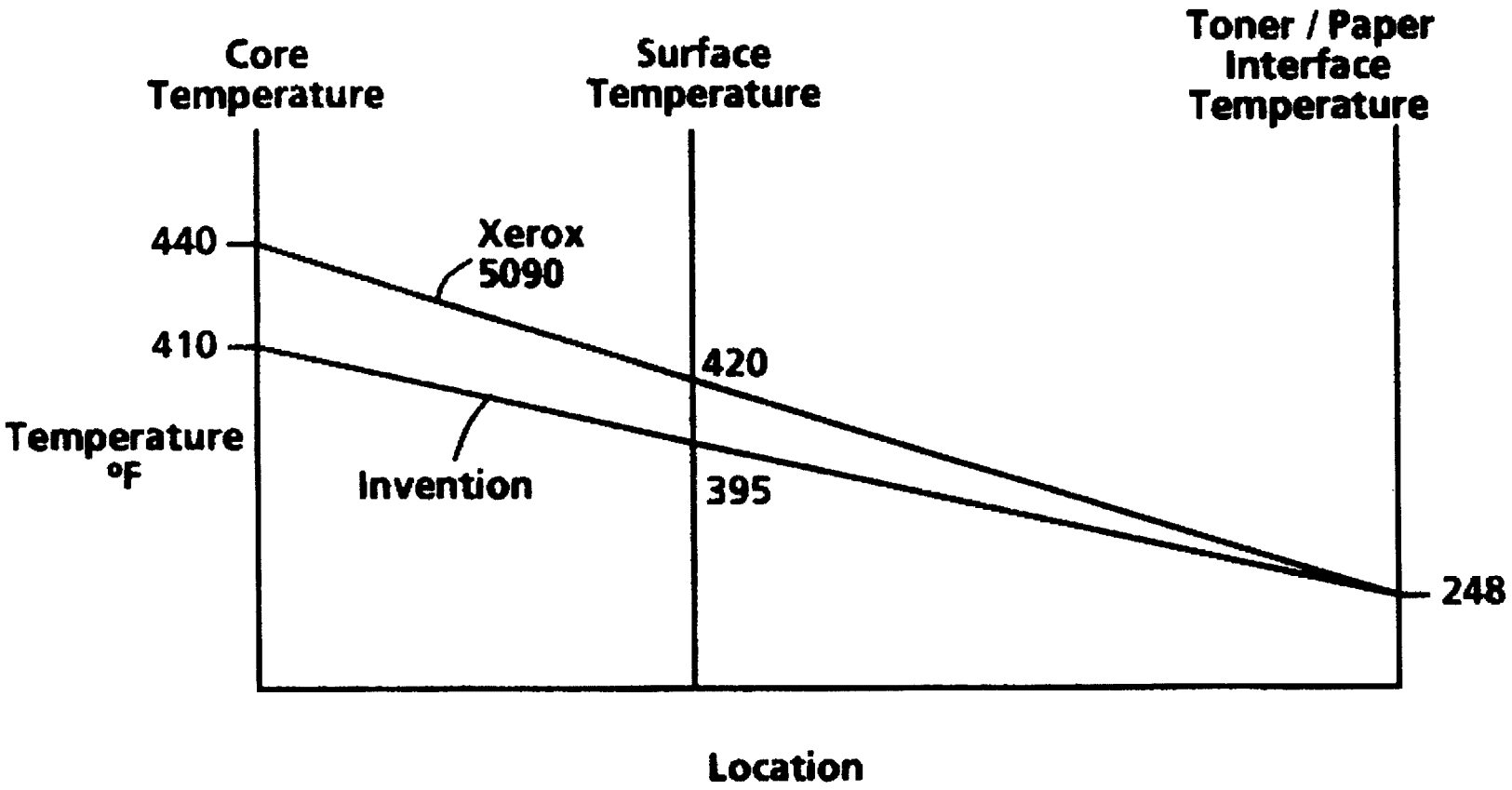
FIG. 5 is a graphical comparison illustrating the improvement in fuser roll core and surface temperature with a fuser roll according to the present invention.

FIG. 5 is a graphical comparison of the fusing surface layer according to the present invention as described in Example II with that obtained according to the fusing layer described in Example I, wherein it is noted that the present invention provides a 30 degree lower core temperature together with a 25 degree lower surface temperature while arriving at the same temperature at the toner/paper interface.

EXAMPLE IV

A fuser roll was prepared as described in Example III and installed in a Xerox 5090 Duplicator which used MICR toner. Standard Xerox mercapto functional silicone oil (designated as FUSER AGENT™) having a formula as described herein was used with a 0.2 mole percent mercapto content as the release agent. The test was terminated after about 1.8 million prints were made with good adherence of the MICR toner to the paper, without release failure, and with no paper jam problems. Throughout this run, the release stripping pressure was maintained at 6–7 psi, which indicated that the surface layer containing the hydrofluoroelastomer and the alumina filler was stable over the life of the fuser roll. The excellent results were accomplished even though the MICR toner had a 20° F. higher minimum fix temperature than the nonMICR toner typically used with the Xerox 5090 Duplicator, which resulted in a harsher fusing environment.

Thus, according to the present invention, a new and improved fuser member and fuser system have been provided. In particular, a fuser member having a higher thermal conductivity to enable adequate toner fix, an unchanged fixing or fusing temperature to the toner/paper interface, lower temperature of the fuser member core, and lower surface temperature of the fuser member have been provided. The present fuser member also has sufficient hardness to compress or tightly fix the toner image to the paper substrate by embedding the toner therein and providing sufficient thermal energy to enable the toner to penetrate the surface of the substrate sheet, while at the same time providing conformability of the toner image by enabling the toner material to flow around the individual magnetically attractable particles and into the paper to fix the toner. Generally, the higher the thermal conductivity, the lower the minimum fix temperature and core temperature are required to be to achieve the same image fix level. Further, reducing the thickness of the surface layer gradually reduces the minimum fix temperature requirements without changing the temperature through the toner. That is fix remains constant. Due to the thinner surface layer heat transfer takes place more readily, enabling a lower surface temperature while the temperature of the toner paper interface remains unaffected. However, too thin an overcoat thickness is not desirable for elastomer conformability.

Crease is better with high filler content and higher thickness in the range of 4 to 9 mils, it being noted that a thinner layer would be desired for cost and heat flow reasons, but that the thickness within the stated range is desired in order to obtain the conformability of the roll to the toner images on the substrate and that beyond about 9 mils the cost of the surface layer becomes excessive without a commensurate improvement in toner fix. For a constant thickness of the layer as the alumina filler loading increases both hardness and thermal conductivity increase in a similar manner. As the hardness increases, however, the reduction in conformability may limit the filler content. According to the present invention the temperature of the core of the fuser roll and the elastomer interface is lowered thereby preserving the life and increasing thermal conductivity to more readily conduct heat to the surface. Furthermore, the toner image is adequately fused and permanently fixed to the paper substrate and does not excessively chip in contact readers. Moreover, the use of mercapto functional release oil with the present fuser member results in the absence of problems of adhesion of ink such as MICR ink to paper substrates such as checks and envelopes.

All the patents and applications referred to herein are hereby specifically and totally incorporated by reference in their entirety in the instant application.

While the invention has been described in detail with reference to specific and preferred embodiments, it will be appreciated that various modifications and variations will be apparent to the artisan. For example, while the invention has been illustrated with reference to a fuser roll, it will be understood that it has equal application to other fuser members, such as flat or curved plate members in pressure contact with the roll. All such modifications and embodiments as may readily occur to one skilled in the art are intended to be within the scope of the appended claims.

It is claimed:

1. A thermally conductive fuser member comprising base member and a surface layer, wherein said surface layer comprises a fluoroelastomer and an alumina filler having an average particle size of from about 0.5 to about 15 micrometers, said alumina being present in an amount of from about 30 to about 55 parts by weight per 100 parts by weight of said fluoroelastomer, to provide a thermal conductivity of at least about 0.24 watts/meter °Kelvin in said surface layer.

2. The fuser member of claim 1 wherein said alumina is calcined alumina.

3. The fuser member of claim 1 wherein said alumina is selected from the group consisting of tabular alumina and fused alumina.

4. The fuser member of claim 1 wherein said fluoroelastomer is a hydrofluoroelastomer.

5. The fuser member of claim 1 wherein said fluoroelastomer comprises a poly(vinylidenefluoride-hexafluoropropylene-tetrafluoroethylene-cure site monomer) wherein the vinylidene fluoride is present in an amount less than 40 weight percent of the polymer.

6. The fuser member of claim 1 wherein said alumina has a particle size distribution of from about 0.5 micrometer to about 8 micrometers.

7. The fuser member of claim 1 wherein said fuser member is a roll.

8. A thermally conductive fuser member in accordance with claim 1, wherein said surface layer further comprises not more than about 30 parts by weight copper oxide per 100 parts by weight of said fluoroelastomer.

9. A thermally conductive fuser member in accordance with claim 8, wherein said copper oxide is present in an amount of from about 12 to about 18 parts by weight per 100 parts by weight of said fluoroelastomer.

10. The thermally conductive fuser member in accordance with claim 1, further comprising an outer layer of a mercapto functional toner release agent on said fluoroelastomer layer.

11. The fusing system of claim 10 wherein said mercapto functional toner release agent is:

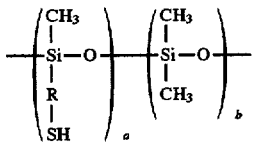

wherein R is an alkyl having 1 to 8 carbon atoms, a ranges from about 2 to about 4, and b is at least about 65.

12. The thermally conductive fuser member in accordance with claim 1, further comprising an outer layer of an amino functional toner release agent on said fluoroelastomer layer.

13. A thermally conductive fuser member comprising a base member and a surface layer, wherein said surface layer comprises a fluoroelastomer and an alumina filler having an average particle size of from about 0.5 to about 15 micrometers, said alumina being present in an amount to provide a thermal conductivity of at least about 0.24 watts/meter °Kelvin in said surface layer, wherein cupric oxide is present in said surface layer in an amount up to about 30 parts by weight per 100 parts by weight of said fluoroelastomer.

* * * * *